United States Patent [19]

Fasching

[11] 4,453,948

[45] Jun. 12, 1984

[54] AIR-FLOW REGULATION SYSTEM FOR A COAL GASIFIER

[75] Inventor: George E. Fasching, Morgantown, W. Va.

[73] Assignee: The United States of America as represented by the United States Department of Energy, Washington, D.C.

[21] Appl. No.: 445,641

[22] Filed: Nov. 30, 1982

[51] Int. Cl.[3] ..... C10J 3/22

[52] U.S. Cl. ..... 48/76; 48/77; 48/87; 137/110; 137/486

[58] Field of Search ..... 48/76, 77, 87; 422/105, 422/110, 111; 137/110, 486

[56] References Cited

U.S. PATENT DOCUMENTS

| | | | |
|---|---|---|---|
| 2,732,289 | 1/1956 | Goeke | 48/76 |
| 3,689,237 | 9/1972 | Stark et al. | 137/110 |
| 3,998,608 | 12/1976 | Livemore | 48/76 |
| 4,325,349 | 4/1982 | Fehrenbach | 137/110 |

*Primary Examiner*—Peter F. Kratz

*Attorney, Agent, or Firm*—David E. Breeden; Stephen D. Hamel; Michael F. Esposito

[57] ABSTRACT

An improved air-flow regulator for a fixed-bed coal gasifier is provided which allows close air-flow regulation from a compressor source even though the pressure variations are too rapid for a single primary control loop to respond. The improved system includes a primary controller to control a valve in the main (large) air supply line to regulate large slow changes in flow. A secondary controller is used to control a smaller, faster acting valve in a secondary (small) air supply line parallel to the main line valve to regulate rapid cyclic deviations in air flow. A low-pass filter with a time constant of from 20 to 50 seconds couples the output of the secondary controller to the input of the primary controller so that the primary controller only responds to slow changes in the air-flow rate, the faster, cyclic deviations in flow rate sensed and corrected by the secondary controller loop do not reach the primary controller due to the high frequency rejection provided by the filter. This control arrangement provides at least a factor of 5 improvement in air-flow regulation for a coal gasifier in which air is supplied by a reciprocating compressor through a surge tank.

4 Claims, 2 Drawing Figures

AIR-FLOW REGULATION SYSTEM FOR A COAL GASIFIER

BACKGROUND OF THE INVENTION

This invention relates generally to fluid flow regulation systems and, more specifically, to an air-flow regulation system for a coal gasifier.

In a fixed-bed coal gasifier, such as the 42-inch, coal-fired, air-blown gasifier at the Morgantown Energy Technology Center, Morgantown, W. Va., air to support combustion is supplied by a reciprocating compressor through a surge tank. It is normal operating practice to supply air from the compressor to meet varying throughput requirements by means of valving within the compressor loading/unloading control system in a stepped manner. This results in pressure cycling at the compressor outlet. The cyclic pressure is somewhat dampened by the surge tank, but at the most severe conditions, the pressure can vary ±10 psi. This causes a ±5,000 standard cubic feet per hour (scfh) deviation in the normal operating flow of 80,000 scfh of air to the gasifier.

An attempt to control the air flow in a conventional manner using a conventional single proportional/integral controller with feedback did not provide adequate flow control (regulation). Solutions, such as installing a much larger surge tank or a pressure regulator, were found not to be practical. Thus, there is a need in this application for an easily implemented and economical means for regulating the air flow.

SUMMARY OF THE INVENTION

In view of the above need, it is an object of this invention to provide a flow control system for improved air-flow regulation in a coal gasifier system.

Other objects and many of the attendant advantages of the present invention will be obvious to those skilled in the art from the following detailed description of the preferred embodiment of the invention.

In summary, the invention pertains to an air-flow regulation system for a coal gasifier wherein pressurized air is supplied by a compressor through a surge tank connected in the air supply line. A first control valve is connected in the supply line for controlling the flow therethrough in response to a control error signal from a primary controller which controls the position of the first control valve. A second control valve is connected in a secondary line paralleling the first control valve which is substantially smaller in size and has a faster acting valve position response. The second valve is controlled by a secondary controller which responds to rapid cyclic deviations in flow and corrects the rapid flow deviation by controlling the position of the second valve in response to an error signal from the secondary controller. A flow-rate transducer is provided in the supply line which generates a signal proportional to the flow and applies the signal to the input of the secondary controller. A low-pass filter is connected between the output of the secondary controller and the input of the primary controller to reject the rapid flow deviation reflected in the error signal. Thus, the primary controller responds to the slower and larger changes in flow and regulates the flow accordingly by positioning the first valve. The primary controller manipulates the first valve such that the sensed flow signal from the flow transducer when acted upon by the secondary controller will maintain the average value of 40% to 60% (set point of primary controller) of the full-scale output of the secondary controller. Any fast deviations about the normal static flow rate deliver an error control signal to the second valve via the secondary controller. The faster deviations in flow will not reach the primary controller due to the high-frequency rejection of the filter. Thus, only slow changes are corrected by the primary controller and the corresponding first valve.

BRIEF DESCRIPTION OF THE DRAWINGS

The accompanying drawings, which are incorporated in and form a part of the specification together with the description, serve to explain the principles of the invention. In the drawings.

DETAILED DESCRIPTION

Figure 1:
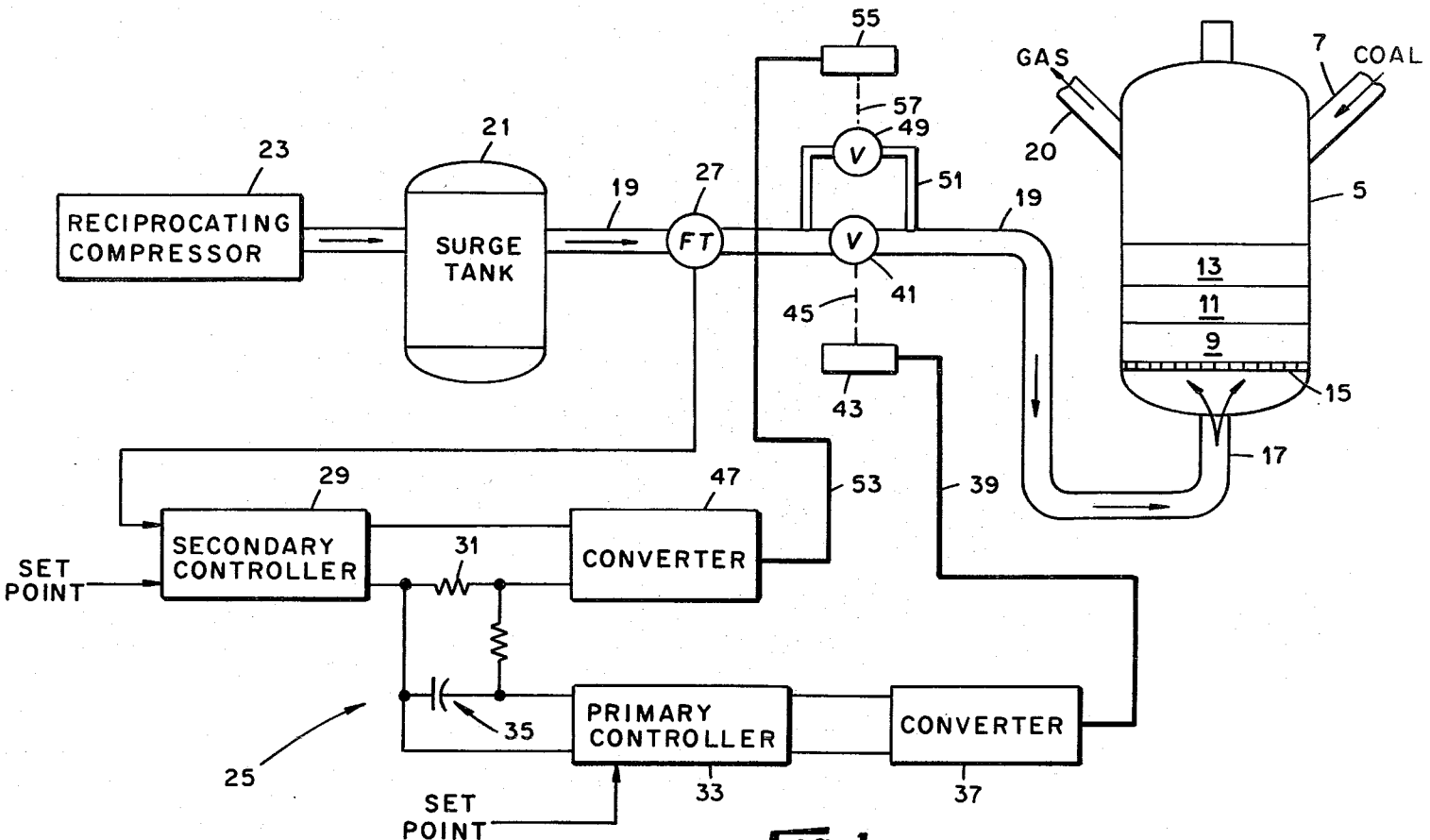
FIG. 1 is a schematic illustration of an air-flow control system for a coal gasifier made in accordance with the present invention.

Referring to FIG. 1, a coal gasifier 5, illustrated schematically, receives coal through an inlet conduit 7 to maintain the coal bed within the gasifier at a prescribed level. The bed includes an ash zone 9 immediately above a grate 15, a combustion zone 11 and a coal layer 13. Air to support combustion enters through an inlet conduit 17 below the grate 15 and circulates up through the bed. The product gas exists through an outlet conduit 20. The air is supplied through a supply line 19 from a surge tank 21 supplied by a reciprocating type compressor 23.

In accordance with the present invention, a flow regulation system senses the air flow by means of a flow-rate transducer 27 connected to detect the flow in the supply line 19 downstream of the surge tank 21. The output of the transducer 27 is connected to the control input of a secondary proportional/integral controller 29. The controller 29 is referred to as a secondary controller because its control is limited to the faster and smaller cyclic changes in the air flow rate.

The output of controller 29 is an error current signal which varies between 4 and 20 milliamps depending upon the controller response to the error in flow rate relative to its setpoint. This current signal flows through a 250 ohm load resistor 31 which provides a voltage signal to the input of a primary controller 33 through a low-pass RC filter circuit 35. The filter circuit 35 has a time constant of between 20 and 50 seconds so that it blocks the passage of the higher frequency cyclic flow changes and allows only the slow changing components of the secondary controller 29 output error signal to reach the input of the primary controller 33. The filter also prevents control system instability caused by control loop interactions. The set point input of the primary controller 33 is placed at 40 to 60 percent of full scale of the controller 29 output, corresponding to a flow rate of approximately 5,000 scfh at valve 49, to allow for nearly equal control deviations of the secondary controller output above and below the primary controller 33 setpoint.

The controllers 29 and 33 may be commercially available controllers which provide both selectable proportional and integral action. One model which is particularly suited for this application is the Beckman Model #8800, supplied by the Beckman Corp., Fullerton, Calif.

The output of the primary controller 33 is a control signal which varies between 4 and 20 milliamps. This control current signal is applied to a current-to-pressure converter 37 which varies the pressure in a pneumatic line connected to a primary valve 41's pneumatic actuator 43. The valve 41 is a 2-inch valve which is placed in the 4-inch supply line 19. The valve opening is controlled through a mechanical link 45 between the pneumatic positioner 43 and valve 41 in accordance with the pressure applied to the positioner 43.

Similarly, a current-to-pressure converter 47, connected to the output of controller 29, operates a smaller valve 49 (½ to ¾ inch) connected in a secondary line (½ to ¾ inch) through a pneumatic line 53, pneumatic actuator 55 and mechanical link 57. The smaller valve 49 has a shorter stroke than the main line valve 41 and is faster to correct for the rapid cyclic deviations in flow, primarily caused by compressor loading and unloading.

The pneumatic valve actuators may be commercially available servo positioners such as the model Valtek Mark 1 valve positioner supplied by Valtek, Inc.

In operation, the primary controller manipulates valve 41 such that the flow signal from the flow transducer 27 when the flow is regulated by the secondary controller 29 maintains the average value of the output of secondary controller 29 at the set point of the primary controller 33. As pointed out above, only fast deviations above the normal static air flow rate will deliver an error control signal to valve 49 via the secondary controller 29. The faster deviations will not reach the primary controller 33 because of the high-frequency rejection of the filter 35. As a result, only slow changes in flow rate will be corrected by the controller 33 and valve 41. The secondary controller 29 and valve 49 will respond initially to all perturbations, but eventually, the primary controller 33 and valve 41 will provide essentially all (except approximately 5,000 scfh) of the corrective action for the slow changes in steady-state flow.

This flow-control system has been tested in an analog computer simulation and found to provide an improvement factor in flow regulation for a system as illustrated here of at least five, based on the integral of the absolute value of the deviation, or $$I_{ERROR} = \int |Q_A - Q_{ASP}| dt$$

which is commonly used measure for the quality of control for a chemical process. In the equation $Q_A$ is the actual flow rate and $Q_{ASP}$ is the set point flow rate.

Figure 2:
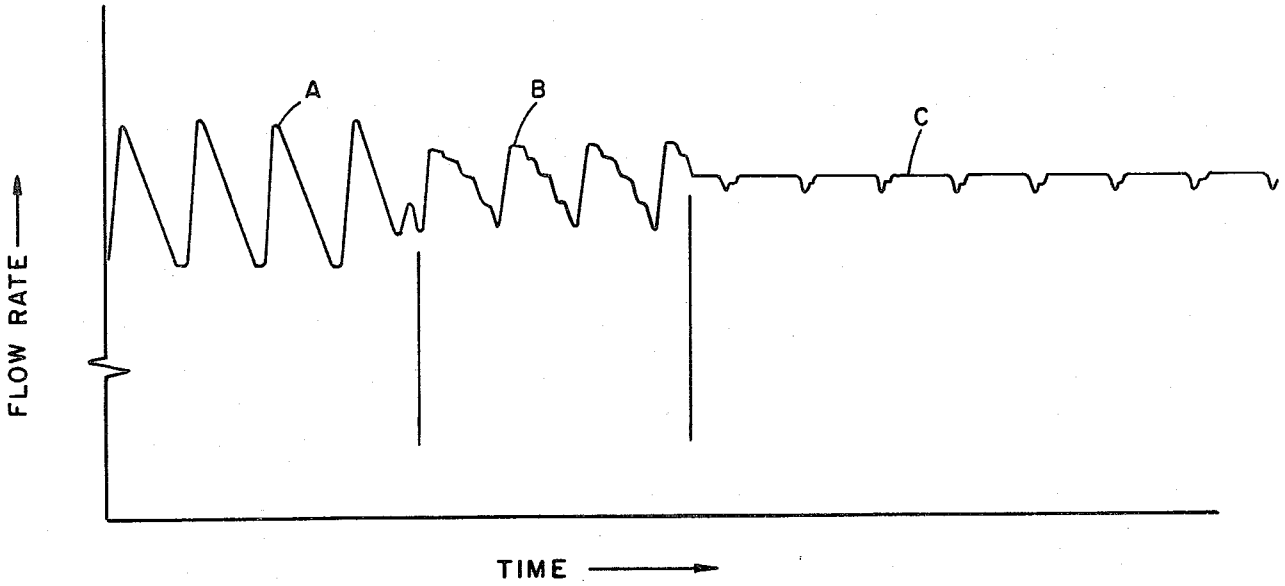
FIG. 2 is a plot illustrating the relative improvement of the air-flow regulation using the two valve control system of FIG. 1 (curve C) compared with a conventional single valve control system (curve B) and a system without automatic control (curve A).

The results of the test can be seen in FIG. 2 which is a strip chart recording of the reponses of a single valve controller (curve B) and the two valve control system according to the present invention, (curve C) to a ±5 psi compressor deviation. These responses are compared with the response of the same system with no automatic flow control (curve A). The results were obtained using an analog computer simulation of the air compressor, surge tank, 4-inch pipe supply line with ½ inch bypass line and corresponding valve/positioners, differential pressure transducer, coal gasifier, and its back-pressure regulator. Actual Beckman Model 8800 automatic controllers were employed in the test with the analog computer simulator. The compressor pressure deviations of ±5 psi were provided in the simulation by a ramp generator set at 0.067 Hz, the normal cyclic frequency of the compressor loading/unloading. The proportional and integral actions and set point settings for the primary and secondary controllers for a steady state flow rate of 80,000 scfh were as follows:

| | |
|---|---|
| Controller 29 | |
| Gain = 15 | Reset Rate = 20 repeats/min. |
| Set point = 80,000 scfh | |
| Controller 33 | |
| Gain = 0.1 | Reset Rate = 1.4 repeats/min. |
| Set point = 50% of full-scale (5,000 scfh at valve 49) | |

Thus, it will be seen that an air-flow regulation system has been provided that allows substantial improvement in flow regulation while being easy to implement and economical to install. This system will provide close flow regulation when faced with supply pressure variations that are too rapid for a single primary control loop to respond.

While a preferred embodiment of the invention has been described using specific terms, such description is for illustrative purposes only, and it is to be understood that changes and variations may be made without departing from the spirit or scope of the following claims.

What is claimed is:

1. A gas flow regulation system for regulating gas flow in a process wherein the gas is supplied under pressure from a compressor through a surge tank and a main supply line to a gas-flow utilization device, comprising:

a first flow control valve disposed in said main supply downstream of said surge tank, a secondary flow line connected in parallel fluid communication with said main supply line bypassing said first control valve, a second flow control valve disposed in said secondary flow line, said secondary flow line and said second control valve being substantially smaller than said main line and said first flow control valve, means for sensing the flow in said main supply line upstream of the bypassing line and providing an output signal proportional to the flow rate of said gas through said supply line, a primary controller means operatively connected for comparing an input signal proportional to the flow rate of said gas in said main supply line provided at an input thereof with a first set point value signal and adjusting the position of said first valve to maintain said preselected flow rate, a secondary control means connected to said means for sensing the flow for comparing the output signal from said flow sensing means with a second set point value signal corresponding to the desired flow rate and adjusting the position of said second valve to maintain said preselected flow rate and generating an output error signal proportional to the deviation of said sensing means output signal from said first set point signal; and a low-pass filter means having a preselected time constant coupling said error signal from said second controller to the input of said first controller so that said first controller only responds to flow-rate deviations from said first set point value which exist for a period greater than the time constant of said filter circuit means, and wherein said first set point value signal corresponds to about 40% to 60% of the full-scale output of said secondary controller.

2. The system as set forth in claim 1 wherein said primary and secondary controller means each include a selectable proportional/integral controller and an actuator means connected to the output of said controller for controlling the respective flow rate valve opening in response to the output signal from said controller.

3. The system as set forth in claim 2 wherein each of said actuator means for controlling each of said valves includes an electrical signal-to-pressure converter, a pneumatic valve positioner coupled to the respective ones of said flow control valves and connected in fluid communication with said converter for positioning the respective flow control valve in proportion to the pressure applied to said valve positioner.

4. The system as set forth in claim 3 wherein said utilization device is a coal gasifier.

* * * * *